US007645506B2

(12) United States Patent
Thiess et al.

(10) Patent No.: US 7,645,506 B2
(45) Date of Patent: Jan. 12, 2010

(54) RADIATION PROTECTION MATERIAL METHOD FOR PRODUCTION OF A RADIATION PROTECTION MATERIAL AND USE OF THE SAME

(75) Inventors: Axel Thiess, Mönchengladbach (DE); Clemens Reizel, Ulm (DE)

(73) Assignee: Paul Hartmann AG, Heidenheim (DE)

( * ) Notice: Subject to any disclaimer, the term of this patent is extended or adjusted under 35 U.S.C. 154(b) by 0 days.

(21) Appl. No.: 12/018,811

(22) Filed: Jan. 24, 2008

(65) Prior Publication Data

US 2008/0128660 A1 Jun. 5, 2008

Related U.S. Application Data

(63) Continuation of application No. 10/516,916, filed as application No. PCT/EP03/06085 on Jun. 10, 2003, now abandoned.

(30) Foreign Application Priority Data

Jun. 8, 2002 (DE) ..... 202 08 918 U

(51) Int. Cl.
*B32B 5/16* (2006.01)
*B32B 27/40* (2006.01)
*B32B 27/00* (2006.01)
*B32B 27/08* (2006.01)

(52) U.S. Cl. ..... 428/323; 428/328; 428/329; 428/330; 428/423.1; 428/424.2; 428/500; 428/515

(58) Field of Classification Search ..... None
See application file for complete search history.

(56) References Cited

U.S. PATENT DOCUMENTS 6,153,666 A * 11/2000 Lagace ..... 523/136

FOREIGN PATENT DOCUMENTS

| | | |
|---|---|---|
| JP | 56131649 | 10/1981 |
| WO | WO 94/16448 | 7/1994 |

* cited by examiner

*Primary Examiner*—Sheeba Ahmed
(74) *Attorney, Agent, or Firm*—Paul Vincent

(57) ABSTRACT

A radiation protection material for the screening of X- and/or gamma-rays is made from a film-like multi-layer composite material, in which radiation absorbing particles are dispersed. The composite material comprises at least one support layer and a radiation absorbing layer, whereby the radiation absorbing layer comprises a hardening polymeric preparation, which can flow in the working state and with an effective lead content of ≦15%.

12 Claims, 2 Drawing Sheets

| Sample no. | Recipe no. | Surface weight / kg/m² | Bending resis-tance / cN | Material thickness / mm | Shielding effect with given X-ray tube voltage | | | | | | | |
|---|---|---|---|---|---|---|---|---|---|---|---|---|
| | | | | | 60 kV | | 80 kV | | 100 kV | | 125 kV | |
| | | | | | LE / mm Pb | Specific LE | LE / mm Pb | Specific LE | LE / mm Pb | Specific LE | LE / mm Pb | Specific LE |
| 1 | 1 | 1.42 | | 0.40 | 0.12 | 30 | 0.13 | 33 | 0.13 | 33 | 0.15 | 38 |
| 2 | 2 | 1.35 | 0.17 | 0.33 | 0.11 | 33 | 0.15 | 45 | 0.14 | 42 | 0.12 | 36 |
| 3 | 2 | | 0.34 | 2x0.33 | 0.24 | 36 | 0.26 | 39 | 0.25 | 38 | 0.22 | 33 |
| 4 | 2 | 1.95 | | 0.45 | 0.17 | 38 | 0.19 | 42 | 0.19 | 42 | 0.17 | 38 |
| 5 | 2 | 1.86 | 0.43 | 0.44 | 0.16 | 36 | 0.18 | 41 | 0.18 | 41 | 0.14 | 32 |
| 6 | 2 | | 1.03 | 2x0.44 | 0.34 | 39 | 0.36 | 41 | 0.34 | 38 | 0.30 | 34 |
| 7 | 2 | 2.85 | 0.88 | 0.64 | 0.27 | 42 | 0.29 | 45 | 0.27 | 42 | 0.25 | 39 |
| 8 | 2 | | 2.06 | 2x0.63 | | | | | | | | |
| 9 | 3 | 1.45 | | 0.35 | 0.12 | 34 | 0.13 | 37 | 0.12 | 34 | 0.12 | 34 |
| 10 | 3 | 1.91 | | 0.43 | | | 0.18 | 42 | 0.17 | 40 | 0.16 | 37 |
| 11 | 3 | 2.76 | | 0.61 | | | 0.26 | 43 | 0.25 | 41 | 0.22 | 36 |
| 12 | 4 | 1.36 | | 0.35 | 0.11 | 31 | 0.12 | 34 | 0.12 | 34 | 0.11 | 31 |
| 13 | 4 | 1.82 | | 0.44 | 0.15 | 34 | 0.21 | 48 | 0.17 | 39 | 0.16 | 36 |
| 14 | 4 | 2.66 | 0.86 | 0.62 | 0.22 | 35 | 0.25 | 40 | 0.25 | 40 | 0.22 | 35 |
| | | | | | | | | | | | | |
| 15 | Xeno-lite lead-free | 1.38 | 0.34<br>0.68 | 0.44<br>2x0.44 | 0.09 | 20 | 0.10 | 23 | 0.15 | 34 | 0.11 | 25 |
| 17 | Xeno-lite lead-free | 1.93 | 1.28<br>2.91 | 0.60<br>2x0.60 | 0.14 | 23 | 0.16 | 27 | 0.17 | 28 | 0.15 | 25 |
| 18 | Supra-sine | 2.09 | 1.11<br>1.80 | 0.65<br>2x0.65 | 0.14 | 22 | 0.18 | 28 | 0.18 | 28 | 0.16 | 25 |
| 19 | Supra-sine | 2.97 | 1.71<br>3.08 | 0.95<br>2x0.95 | | | (0.26) | | | | | |

Fig. 2

RADIATION PROTECTION MATERIAL METHOD FOR PRODUCTION OF A RADIATION PROTECTION MATERIAL AND USE OF THE SAME

This is a continuation of Ser. No. 10/516,916 filed on Dec. 6, 2004 now abandoned which was the national stage of PCT/EP2003/006085 filed on Jun. 10, 2003 and also claims Paris Convention priority of DE 202 08 918.5 filed on Jun. 8, 2002 the entire disclosures of which are hereby incorporated by reference.

BACKGROUND OF THE INVENTION

The invention concerns a radiation protection material for shielding X-rays and/or gamma rays made from a foil-like, multi-layer material in which ray-absorbing particles are dispersed.

Foil-like materials for the production of X-ray protection aprons and other radiation-absorbing applications are conventionally produced with the addition of metallic lead powder or also lead salts such as oxides or sulfides and polymers such as e.g. PVC plastisol, EVA copolymers or caoutchouc. However, lead is considered to be a toxic substance. So-called lead aprons moreover have a weight which impairs the activities of the persons wearing them.

Prior art discloses some products which attempt to avoid these disadvantages. WO 93/11544 discloses e.g. a radiation-resistant film having a thermoplastic elastomer which contains between 60 and 90 weight % of barium sulfate or a different barium salt.

EP 0 371 699 A1 discloses an energy-absorbing material comprising a layer which consists of a polymer composition having 7 to 30 weight % of a specific polar thermoplastic polymer, 0-15 weight % softener and 70 to 93 weight % of an inorganic composition. The inorganic composition thereby consists of at least two elements which are supposed to provide better protection from radiation than lead.

Moreover, EP 0 372 758 A1 discloses a material which consists of 4 to 19 weight % of a polar thermoplastic polymer, 0 to 10 weight % of a softener and 81 to 96 weight % of an inorganic compound.

Further flexible multi-layer X-ray protection materials are disclosed in G 94 02 609.2 and DE 201 00 267 U1.

DE 199 55 192 A1 discloses a method for producing a radiation protection material using a thermoplastic, vulcanisable elastomer to which a metal powder is added.

U.S. Pat. No. 6,153,666 discloses a polymer matrix with embedded metal for shielding X-rays, wherein the polymer matrix is a plastified non-elastomeric polymer.

It is the underlying purpose of the invention to present a radiation protection material which provides high radiation protection over a wide application and energy range, with the material having low weight and high flexibility.

SUMMARY OF THE INVENTION

This object is achieved in accordance with the invention by a radiation protection material for shielding X-rays and gamma rays made from a foil-like multi-layer material in which radiation-absorbing particles are dispersed, wherein the layer material comprises at least one carrier layer and at least one radiation-absorbing layer, wherein the radiation-absorbing layer contains a thermosetting polymer preparation which is flowable in the processing state, with the effective lead content being ≦15 weight %.

In this manner, a composition is provided whose radiation-absorbing layer is flowable in the state in which it is applied to the carrier layer, i.e. either liquid or viscous like a syrup and is, in particular, within the range of 20,000 to 100,000 mPa s. The flowability should thereby preferably be below 80°, preferably at room temperature. At temperatures above 80° C., the polymer preparation could be hardened.

In a first embodiment, the thermosetting polymer preparation may comprise a PVC plastisol which is flowable at room temperature. The polymer preparation may moreover comprise a synthesized liquid rubber. Such a preparation permits plastification and vulcanisation of the liquid, cross-linkable and vulcanisable polymer matrix in one step, thereby hardening it. After hardening, a three-dimensional wide-meshed plastic structure is obtained which has a rubber elastic behavior.

The liquid synthesis rubber belongs to the group of the special caoutchoucs. They have a lower viscosity than the classic caoutchoucs, which are unlinked polymers (which can be cross-linked (vulcanised)) having rubber-elastic properties at room temperature. At higher temperatures and under the influence of deformation forces, caoutchouc is also viscous and can therefore be shaped under suitable conditions. In contrast thereto, liquid rubber facilitates introduction of additives such as vulcanisation accelerators, fillers, softeners or activators and are based on silicon, polyurethane, polyesters, polyethers and diene caoutchouc. The liquid silicon rubbers primarily "cold hardening" one-component type RTV. They are branched polydimethyl siloxanes with silanol end groups which are mixed e.g. with tetrabutyl titanate or triacetoxymethyl silane and are vulcanised through addition of air moisture. Liquid polyurethane rubbers mostly consist of polyurethane with isocyanate end groups and are generally vulcanised with weak basic di- and polyamines. Liquid diene rubbers are produced mainly through anionic polymerization of dienes with bi-functional starters. The macro diene ions produced are converted with carbon dioxide, ethylene oxide or ethylene sulfide into polymers with carboxy, hydroxy or sulfhydryl end groups. Vulcanisation is achieved through reaction of these end groups with e.g. polyfunctional isocyanates. The concentration of the cross-linking agents must be relatively high due to the low mol masses of the liquid rubbers. While the properties of the resulting elastomers of the liquid rubbers on the basis of polyurethane are similar to those of regular polyurethanes, vulcanisates of liquid diene rubbers have much lower tear resistances and tear extension than vulcanisates of regular diene caoutchoucs.

The plastisoles which can be used in accordance with the invention are a dispersion of plastic materials, in particular of polyvinyl chloride presented by emulsion or micro emulsion polymerization, in organic solvents having a high boiling temperature which act as polymer softeners at higher temperatures. During heating, the solvents diffuse into the dispersed plastic particles, are deposited between the macro molecules and cause plastification of the plastic materials. During cooling, these treated materials gel into flexible, form-stable and wear-resistant systems whose properties can be influenced through added auxiliary substances such as pigments or stabilizers.

In particular, all plastifiable polymers or copolymers or block polymers or polymer mixtures in a dissolved or mixed form may be used as plastisols in one or more softeners, e.g. PVC plastisol, polyolefin plastisol and LDPE plastisol or HDPE plastisol as well as polymetacrylate plastisol or mixtures thereof.

All liquid rubbers such as polyurethane rubbers, silicon rubbers and further synthesis rubbers on the basis of polyesters, polyether or diens which are flowable or liquid to a temperature of 80° C. can be used as synthesis rubber, such as e.g. acrylonitril butadiene synthesis rubbers.

In particular, a composition may be provided wherein the polymer preparation has between 20 and 40 weight % of PVC and between 10 and 35 weight % of the liquid synthesis rubber, in particular, of an acrylontril butadiene polymer and additional substances of between 0 and 10 weight % such as e.g. stabilizers, ageing protection means, starters and accelerators, the rest being softeners.

In particular the portion of PVC is between 25 and 35 weight % and, in particular, between 29 and 32 weight %. Liquid rubber may contain, in particular, between 15 and 25 weight % and in particular between 17 and 23 weight % of liquid rubber, in particular acrylonitril butadiene polymer.

In particular, the effective lead content may be ≦10 weight %, in particular ≦5 weight % and in particular ≦1 weight %, and in particular 0 weight %, i.e. it is a material which contains no toxic lead.

The specific lead content of the material may be ≧30, in particular ≧32 and preferably ≧35 at a tube voltage in a range of 60 to 125 kV. The lead equivalent of the material being a specific lead equivalent may be ≧30 at least two measuring points which have a difference of at least 20 kV in a tube voltage region of between 60 and 125 kV according to IEC 1331-1/EN 61331, in particular at three or more different points, wherein the points with the greatest difference differ e.g. by 40 kV, in particular 45 kV and with particular preference 65 kV. Measurements are taken at e.g. 60 kV, 80 kV and 100 kV and 125 kV and the specific lead equivalent at all of these measuring points and in particular also in the regions therebetween is ≧30, in particular ≧32 and in particular ≧34.

The specific lead equivalent is a measurement to determine the shielding values and thereby the lead equivalent in accordance with IEC 1331-1/EN 61331, wherein the values were normalized to the thickness of the sample and the thickness was measured through mechanical scanning according to DIN 53370. The thickness was measured on the basis of the following values:

Measuring surface: round, diameter 10 cm

Measuring force: 0.8N

Pressing force: 10 kPa+/−2 kPa

Scalar subdivision: 0.01 mm

Measuring accuracy: +/−0.01 mm

Surface weight: measuring inaccuracy +/−0.02 kg/m$^2$.

The lead equivalent was determined in accordance with the stated norm through a differential measurement, i.e. the radiation amount which impinges on a detector is measured, once as an empty measurement and once with a radiation-absorbing material, and the passed radiation is determined from the difference of these values. The experimental set-up can thereby be derived from IEC 131-1/EN 61331. The lead equivalent is determined via the amount of passed radiation. The radiation source is thereby an X-ray tube with a standard tungsten anode and operated at 300-500 mA. The radiation is discharged in a dosed manner for 10 to 100 ms. The radiation characteristics thereby reflect those of the radiation used in the medical field. For comparison, the value was defined as a specific lead equivalent in dimensionless ratio to lead, wherein the inaccuracy is +/−1.

In a further embodiment, the support layer may also consist of PVC plastisol material and/or polyurethane and/or polyester and/or polyolefines and/or silicon caoutchoucs and/or the polymer preparation of the radiation-absorbing layer. In principle, radiation-absorbing particles can also be introduced into the carrier layer, the particles leading to a radiation-absorbing effect of the carrier layer. The composition of one or more carrier layers and of one or more radiation protection layers may produce a material which is extremely flexible and thin, in particular lead-free and has a foil-like structure. The sequence of the layers can thereby be freely selected. The layers may consist of different materials and have different properties. In this manner, the material is suited, in particular, for textile applications. Due to the high flexibility and the low weight, the activities of the person carrying it will not be impaired, while thereby achieving a high radiation protection through the high specific lead equivalent. In particular, the carrier layer thereby provides rigidity.

The portion of the polymer preparation of the radiation-absorbing layer may be less than 20 weight %, but more than 0 weight % and the portion of the radiation-absorbing particles is more than 80 weight %. In particular, the polymer preparation on the radiation-absorbing layer may be between 5 and 20 weight % and in particular between 10 and 20 weight %. The portion of radiation-absorbing particles may be in particular between 80 and 95 weight % and preferably between 80 and 90 weight %. The amount of the polymer preparation must thereby be sufficient to securely bind the particles introduced therein.

In a first embodiment, the radiation-absorbing particles may comprise tin, bismuth, barium and/or tungsten, wherein the metal itself, metal oxides or metal salts may be selected. The effective amount of the radiation-absorbing particles in the radiation-absorbing layer should thereby contain in particular 55 to 75 weight % tin powder, between 0 and 30 weight % bismuth, 0 to 10 weight % barium and/or 0 to 20 weight % tungsten, wherein the sum is 100 weight % in each case. Such a polymer preparation with introduced radiation-absorbing particles permits optimization of the shielding behavior, and also of the weight, flexibility and radiation protection effect. The use of metals instead of oxides or salts always has a positive effect on the weight of the material compared to a metal salt or metal oxide of the same metal, and provides the same shielding effect.

If lead portions are contained, these may be pure lead and also lead oxide and lead salts.

In a further development of the invention, the tin powder consists of a mixture of two tin powders of different grain size distribution with approximately equal weight ratios.

Approximately 90% of the particles of the first tin powder (TEGO 30) are thereby smaller than 125 μm and approximately 90% of the particles of the second tin powder (TEGO 60) are smaller than 75 μm. The bismuth oxide powder which can be used has a $D_{50}$ value in the range of 4 to 100 μm.

The multi-layer material preferably has a surface weight of 1.2 to 1.5 kg/m$^2$, wherein in particular a value of approximately 1.35 kg/m$^3$ is desired. The multi-layer material thereby has a foil thickness of 0.3 to 1.2 mm, in particular of 0.3 to 0.5 mm, preferably 0.35 to 0.45 mm.

The radiation protection material may thereby be designed such that the support layer can be washed or is wear-resistant on its side facing away from the radiation-absorbing layer and/or is resistant to alcohols and/or disinfectants or has textile properties, wherein e.g. flock-coating is provided which safeguards the desired tactile properties during wearing a product produced from the material. Moreover, wear resistance may be provided to extend the service life of a product produced from this material and washability to permit easy cleaning of articles produced therefrom after use, in particular in the medical field.

The material may finally be very flexible. The bending resistance, which is a measure of the flexibility of the material, was determined in accordance with DIN 53121 and was compared with the bending resistance of other lead-free radiation protection foils. The bending resistance, which depends on the width of the lead-free materials, was measured using the three-point Balker method, the test being carried out on a Zwick testing machine. The calculation formula according to Din 53121 is:

$$S(\text{width-dependent bending resistance})=(F(cN)/f)\times(l^2/48b).$$

The width of the sample is thereby: b=35 mm

Measuring length: l=30 mm

Maximum bending: f=5 mm

Materials having a bending resistance of, in particular, less than 1 cN are particularly preferred. In a particularly preferred manner, a shielding effect in the above-mentioned region or at individual points≧30 in particular ≧32 and in particular ≧34 relative to the specific lead equivalent is simultaneously obtained.

The invention also concerns a method for producing a radiation protection material comprising the following steps:

- providing a carrier layer, preferably produced through doctoring and drying onto a substrate,
- producing the material for the radiation-absorbing layer from a liquid, pourable polymer matrix and continuous or discontinuous adding of radiation-absorbing metal particles,
- disposing, pouring, doctoring and/or applying the material for the radiation-absorbing layer onto the carrier layer,
- thermal, chemical and/or physical cross-linking or hardening of the polymer matrix.

In particular, the method may serve for producing a radiation protection material of the above described type.

After production of the pourable liquid polymer matrix, the liquid phases may be mixed before the radiation-absorbing particles are added. The overall material for the radiation-absorbing layer may be processed such that the particles are homogeneously distributed and then degassed before disposing, pouring, doctoring and/or applying onto the carrier layer. To condense the solid particles in the polymer matrix, the radiation-absorbing layer may additionally be subjected to ultrasound after being disposed onto the carrier layer.

Finally, in a particularly preferred embodiment, the carrier layer is connected to the radiation-absorbing layer not only in an adhesive manner but is integrally connected to the radiation-absorbing layer through cross-linking of the two layers during application and thermosetting of the radiation-absorbing layer on the carrier layer. The layers are physically anchored to each other and therefore permanently attached in a non-releasable manner. This is effected e.g. through use of a PVC plastisol in the radiation-absorbing layer if the material of the carrier layer is selected such that the PVC plastisol can dissolve it.

The invention also involves use of the radiation protection material in accordance with one of the preceding claims as radiation protection clothes, in particular as radiation protection apron or radiation protection loincloth or coat or flexible barriers such as covers or curtains.

This permits simple production of a radiation protection material, wherein uniform, quick and homogeneous distribution of the metal particles in the polymer matrix can be ensured since uniform distribution in a liquid polymer matrix can be easily realized and cumbersome kneading or walking which is required for conventional radiation protection foil materials can be omitted. The generated radiation protection material of several layers is very flexible and is uniformly radiation-absorbing over a large energy range.

Further advantages and features can be extracted from the additional disclosures.

The invention is explained in more detail below with reference to the drawings.

BRIEF DESCRIPTION OF THE DRAWING

FIG. 2 shows a table of the different material parameters.

DESCRIPTION OF THE PREFERRED EMBODIMENT

Figure 1:
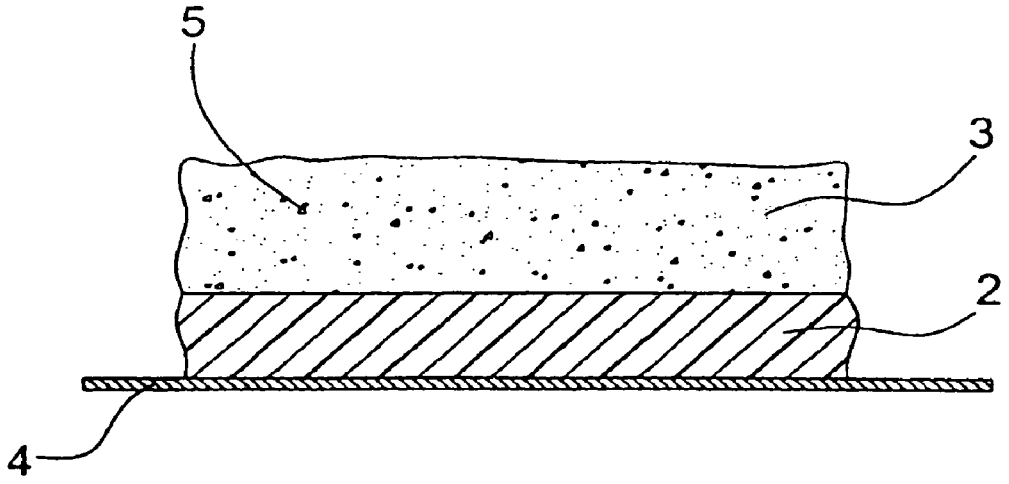
FIG. 1 shows a section through an inventive radiation protection material.

FIG. 1 shows a cross-section through the lead-free foil-like radiation protection material which is disposed onto a separating paper 4 coated with silicon. The separating paper 4 may be structured to produce a structure, e.g. a leather structure, on a carrier layer 2.

The carrier layer 2 of a PVC plastisol film is formed through doctoring onto a separating paper 4 coated with silicon and subsequent gelling at 190 to 200° C. The carrier layer 2 provides the radiation protection material with sufficient rigidity. A paste of the radiation absorbing layer 3 is subsequently doctored onto this carrier layer 2 having a surface weight of 70 to 80 g/m$^3$, and then cross-linked or vulcanised in a drier at approximately 200° C. The radiation absorbing layer 3 is thereby attached to the carrier layer 2 in a permanent and non-releasable manner. The overall thickness of the foil-like layer material is then approximately 0.35 to 0.45 mm and has an overall surface weight of approximately 1.35 kg/m$^2$. The paste forming the radiation absorbing layer consists of a PVC plastisol and a solvent-free and water-free acrylonitril butadiene liquid rubber and the metallic additional substances of tin powder and bismuth oxide powder. The polymer mixture of the radiation-absorbing layer 3 has 13 weight portions of polymer material, 65 weight portions of tin powder and 22 weight portions of bismuth powder. The tin powder consists of two different types of different grain size distribution (product name: TEGO tin granules, TEGO 30 BG, TEGO 60 BG—company Ecka Granules).

The tin powders having a different grain size distribution are mixed in a ratio of 1:1. The bismuth powder is referred to also as yellow bismuth ($Bi_2O_3$) in the vernacular. The $D_{50}$ value (grain size distribution) is maximally 10 μm with a typical value of 5.5 μm.

After production, the lead-free radiation protection material may at first remain on the silicon-coated separating paper layer 4 until it is fabricated e.g. into a radiation protection apron.

A preferred lead-free recipe is stated below.

| | |
|---|---|
| Polymer mixture | 13 weight % |
| Tin powder TEGO 60 BG (metallic) | 35 weight % |
| Tin powder TEGO 30 BG (metallic) | 30 weight % |
| Bismuth trioxide ($Bi_2O_3$) | 22 weight % |

An example of a polymer mixture is given below

| | Weight portions (g) |
|---|---|
| DINP (softener) | 3.400 |
| TXIB (softener) | 600 |
| Tin oxide (ZnO) | 100 |
| Sulfur (S) | 100 |
| Vulkacit D (vulcanisation accelerator) | 60 |
| Vulkacit M (vulcanisation accelerator) | 60 |
| Vestolit 1415 K 80 (PVC) | 2,800 |
| Tegopren (dispersing agent/anti-tack) | 200 |
| Nipole 1312 LV (liquid rubber) | 1,600 |
| Total | 8,820 |

A weight portion of this polymer mixture of approximately 13 weight % is disposed in the initially pasty radiation-absorbing layer. The portion of PVC is approximately 31 weight %, the portion of liquid rubber approximately 18 weight % and the portion of softener approximately 45 weight % of the polymer composition.

The carrier layer 2 thereby has the following composition:

| | |
|---|---|
| PVC | 40 to 70 weight % |
| Softener (DINP) | 30 to 50 weight % |
| Additional substances for ageing protection, ozone resistance, color pigments | 0.1 to 0.5 weight % |

EXAMPLE

| | Weight portions (g) |
|---|---|
| Vestolit 1430 K90 | 3000 |
| TXIB (softener) | 60 |
| DINP (softener) | 1740 |
| Stabilizer | 60 |
| Total | 4860 |

The viscosity can be adjusted through variation of the portion of the softener TXIB.

Such a radiation protection material having a foil thickness of 0.35 to 0.4 mm and an overall surface weight of 1.35 kg/m$^2$ achieves the following lead equivalent in accordance with the testing method IEC 1331.1/EN 61331 in dependence on the tube voltage of an X-ray source:

0.14 mm Pb at 60 kV 0.15 mm Pb at 80 kV 0.15 mm Pb at 100 kV 0.13 mm Pb at 150 K to obtain a specific lead equivalent, normalized to the thickness, of more than 30.

In contrast to the conventional radiation protection materials, the inventive radiation protection material shows no drop in the effective shielding degree at a tube voltage of more than 100 kV and is constant within the predetermined tolerance limits of the international standard IEC 1331-1/EN 61331 over a voltage range of 60 to 150 kV.

The second figure shows a table stating the sample number, the recipe number, the surface weight, the bending resistance, the material thickness and the subsequent respective shielding effects in specific and general lead equivalents at a given X-ray tube voltage of 60 kV, 80 kV, 100 kV and 125 kV. The sample numbers 1 to 14 refer to inventive radiation protection materials. The samples no. 15 to 19, Xenolite lead-free and Suprasine, are commercially available products for lead-free radiation protection materials. The specific lead equivalent of the X-ray tube voltage is defined as the lead equivalent at X-ray tube voltage×100/material thickness.

The lead equivalent was determined in accordance with IEC 1331-/FN 61331.

The compositions for the radiation protection layer are thereby as follows:

Recipe 1: 13 weight % polymer preparation, 65 weight % tin powder, 22 weight % bismuth trioxide.

Recipe 2: 11 weight % polymer preparation, 62 to 66 weight % tin powder, 27 to 23 weight % bismuth powder.

Recipe 3: 10 to 11 weight % polymer preparation, 60 to 64 weight % tin powder, 18 to 20 weight % bismuth powder, 8 to 10 weight % tungsten powder.

Recipe 4: 12 weight % polymer preparation, 65 weight % tin powder, 10 weight % barium fluoride, 13 weight % tungsten powder.

The composition of the polymer preparation for recipes 1 to 4 is thereby:

| Composition | Weight % |
|---|---|
| di-isononylphtalate (DINP) company Vestolit | 38 |
| 2,2,4 trimethyl-1.3-pentandiol-diisobutyrate (TXIB) - company Kran Chemie | 6 |
| Tin oxide active - company Rheinchemie Rheinau GmbH | 1 |
| Mahlschwefel - company Solveig | 1 |
| N,N'-diphenyl guanidine (Vulkacit D) - company Rheinchemie Rheinau GmbH | 0.5 |
| 2-mercaptobenzothiazole (MBT, Vulkacit Merkapto) - company Rheinchemie Rheinau GmbH | 0.5 |
| PVC (Vestolit P 1415 K 80) - company Vestolit | 31 |
| Ba/Zn stabilizer for PVC (Mark BZ 505) - company Compton Vinyladditiv GmbH | 1 |
| Vulkanox DDA, (ageing protection means) company Rheinchemie Rheinau GmbH | 1 |
| Acrylonitril butadiene polymer (Nipol 1312 LV) - company Zeon Deutschland GmbH | 19 |
| Alkyl-polydimethyl siloxane (TEGOpren 6814) company Goldschmidt AG | 1 |

The table shows that the samples taken, in particular according to recipe 2, have a particularly good specific lead equivalent compared to the conventional products, in particular over a tube voltage range of at least 20 kV difference, wherein the absolute voltage values are between 60 and 125 kV.

To obtain a shielding value of 0.175 Pb, a xenolite material of a thickness of 0.6 mm is consequently required, thereby producing a bending resistance of the material of 1.28 cN. Suprasine requires a thickness of 0.65 mm to obtain this shielding effect, thereby having a bending resistance of 1.11 cN. The inventive composition in accordance with e.g. recipe 2 requires merely a thickness of 0.45 mm to obtain this shielding value and achieves a bending resistance of 0.43 cN which permits production of particularly lightweight and flexible materials which are pleasant for the person carrying it, in particular for the production of textiles such as clothes and barriers.

We claim:

1. A radiation protection material for shielding X-rays and/or gamma rays made from a multi-layer material in which radiation-absorbing particles are dispersed, the protection material comprising:

at least one carrier layer; and a radiation absorbing layer, said radiation-absorbing layer comprising 10 to 20 weight % of a polymer preparation and 80 to 90 weight % of said radiation-absorbing particles, said polymer preparation comprising a PVC plastisol mixed with a liquid rubber component prior to hardening thereof and containing between 20 and 40 weight % PVC polymer and 10 to 35 weight % liquid rubber, said radiation absorbing particles containing 55 to 75 weight % tin powder, 0 to 30 weight % bismuth, 0 to 10 weight % barium and/or 0 to 20 weight % tungsten and/or oxides and salts of these metals and mixtures thereof, said radiation absorbing layer being integrally connected to said at least one carrier layer by cross-linking said absorbing layer to said carrier layer and by thermosetting of said absorbing layer on said carrier layer to form the multi-layer material.

2. The radiation protection material of claim 1, wherein the liquid rubber is acrylonitril butadiene polymer.

3. The radiation protection material of claim 1, wherein said polymer preparation contains 25 to 35 weight % PVC polymer and 15 to 25 weight % liquid rubber.

4. The radiation protection material of claim 3, wherein said polymer preparation contains 30 weight % PVC polymer and 20 weight % liquid rubber.

5. The radiation protection material of claim 1, wherein a specific lead equivalent is ≧30 at a tube voltage in a tube voltage range between 60 and 125 kV in accordance with IEC 1331-1/EN 61331.

6. The radiation protection material of claim 5, wherein a specific lead equivalent is ≧32.

7. The radiation protection material of claim 6, wherein a specific lead equivalent is ≧34.

8. The radiation protection material of claim 5, wherein said specific lead equivalent is ≧30 at least two tube voltages having a difference of at least 20 kV in a tube voltage range between 60 and 125 kV in accordance with IEC 1331-1/EN 61331.

9. The radiation protection material of claim 8, wherein said specific lead equivalent is one of ≧32 and ≧34, said tube voltages differing by one of 40 kV, 45 kV and 65 kV.

10. The radiation protection material of claim 1, wherein said carrier layer comprises at least one of PVC plastisol material, polyurethane, and polyester.

11. The radiation protection material of claim 1, wherein the multi-layer material has a thickness of 0.3 to 1.2 mm.

12. The radiation protection material of claim 1, wherein said at least one carrier layer can be washed, is abrasion-resistant, and/or has textile properties on its side facing away from the radiation absorbing layer.

* * * * *